United States Patent [19]

Weigl et al.

[11] 4,108,466

[45] Aug. 22, 1978

[54] SKI BRAKE

[75] Inventors: Erwin Weigl, Brunn am Gebirge; Josef Svoboda, Schwechat, both of Austria

[73] Assignee: TMC Corporation, Baar, Switzerland

[21] Appl. No.: 809,192

[22] Filed: Jun. 23, 1977

[30] Foreign Application Priority Data

Jun. 25, 1976 [AT] Austria ..... 4688/76
Jul. 9, 1976 [AT] Austria ..... 5033/76

[51] Int. Cl.[2] ..... A63C 7/10
[52] U.S. Cl. ..... 280/605
[58] Field of Search ..... 280/605, 604

[56] References Cited

U.S. PATENT DOCUMENTS 3,989,271 11/1976 Riedel ..... 280/605
4,014,563 3/1977 Weigl et al. ..... 280/605

*Primary Examiner*—David M. Mitchell

*Attorney, Agent, or Firm*—Blanchard, Flynn, Thiel, Boutell & Tanis

[57] ABSTRACT

A ski brake for preventing the runaway of a ski. A pair of brake legs are pivotally mounted at each side of the ski for alternately occupying an inactive position alongside of and parallel with the ski or an active position projecting downwardly from the ski. A generally U-shaped member is connected to the brake legs and lies against the upper surface of the ski and under the ski boot when the latter is in position on the ski. The U-shaped member is so arranged as to be subjected to tension when pressed down against the ski by the ski boot with such tension being relieved when same is permitted by removal of the ski boot to spring up away from the ski and to move the brake legs into the above-mentioned active position. A stepping plate and a lever are pivotally connected to each other and cooperate with the U-shaped member to effect the aforementioned movement toward the ski when the ski boot is placed in position on the ski between the ski bindings.

10 Claims, 5 Drawing Figures

SKI BRAKE

This is an improvement in the structure illustrated in U.S. Pat. No. 4,014,563.

FIELD OF THE INVENTION

The invention relates to a further development on a ski brake for skis having a lever which is pivotally supported against a spring force on the ski, which lever is movable automatically into a braking position under the action of this spring force and projects in this position over the ski with downwardly directed braking legs, wherein the part of the lever which terminates in the braking legs consists of spring steel wire and is guided starting out from a stepping plate through and below a holding plate which is secured on the ski and serves as a pivot bearing for the braking legs and wherein an extension extends directly to the stepping plate from each braking leg as shown in U.S. Pat. No. 4,014,563.

BACKGROUND OF THE INVENTION

The known ski brake in U.S. Pat. No. 4,014,563 has proven itself in practice, however, it has the disadvantage that the stepping plate, which in the known construction is made of plastic, suffers too much due to the repeated bending stresses which are generated under the most varying of weather conditions. In spite of a use of suitable material same shows after a certain amount of time signs of fatigue which eventually lead to breakage of the stepping plate.

The object of the present invention here is to provide a solution to overcome the disadvantages of the present stepping plate construction without, however, doing away with the existing advantages of this stepping plate, or having to show limitations in the function.

The aforementioned object is inventively attained by providing on the stepping plate on the side thereof which faces the support part of the holding plate, at least one receiving place for an axle to which a holding or lever arm, which supports the stepping plate on the holding plate, is also hinged, and by mounting to the lower side of the stepping plate a shoulder or the like, which forms a stop for the holding or lever arm.

The inventive construction maintains the advantages of the abovementioned known ski brake unchanged and through the use of a separate axle on which both the stepping plate and also the lever arm are supported, the presently existing breakage point is overcome. This solution was not readily apparent in the present invention, because the use of a conventional hinge would have brought about a different disadvantage. Namely in such a construction it would not have been possible to prevent the holding or lever arm which is supported on the holding plate or its adjusting part which is supported in the center recess of the holding plate from becoming free from the bearing. In using such an improperly adjusted ski brake, a lateral pulling in of the braking legs for downhill skiing would not have been possible, because the tensioning force which is necessary for this operation would have been cancelled. For this reason, the use of a free axle between the stepping plate and the holding or lever arm was first out of the question. Only by a simultaneous use of the second measure namely that between the stepping plate and the holding or lever arm a structural part which serves as a stop is mounted and forms a limit for the free movement of the two structural parts which are held on the axle, was it possible to assure the advantages of an axle without reducing the safety factor for a proper functioning of the device.

Ski brakes of this type are generally mounted below the ski boot sole. Therefore, in developing the stepping plate, adjustments to differently designed ski boot soles were also considered. In the recent past, ski boots have been designed so that the soles have a planar surface thereon, however, lately ski boots are again being manufactured with recesses in the sole, which recesses lie in front of the heel area. According to a further characteristic of the invention, an adjustment to such ski boots is achieved by placing an attachment onto the stepping plate, the vertical cross section of which lies in longitudinal direction of the ski and corresponds substantially to the cross section of the recess of the associated ski boot and the corresponding areas of support and recess have preferably a common tangent which determines in clamped-in condition of the ski boot the position of the stepping plate. This measure assures a particularly favorable adjustment of the ski brake to the ski boot. Adjustment may take place both simultaneously with the mounting of the ski binding parts and also at a later time, if the ski brake is added later. Since the mounting of ski bindings — but for the rental constructions — occurs individually and ski boot related, it is also easy to accomplish the adjustment of the ski brake without special difficulties.

However, it may occur that a skier may want to use one time a ski boot with a continuous flat sole and one time a different ski boot, the sole of which has a recess therein, on his ski with existing ski binding parts and ski brake. In order to meet also such demands, according to a further characteristic of the invention the attachment on the stepping plate is releasably mounted for example by means of screws.

In the described construction, a corresponding relatively heavy and strong dimensioning of the diameter of the joint axle is necessary. Thus, the receiving points are to be designed also with correspondingly large bores which causes again the dimensions of the areas of the stepping plate and of bearing part of the holding or lever arm which surround the receiving points to be constructed in a reinforced manner. This situation may possibly lead to a superelevated positioning of the ski boot.

The invention has also the purpose to aid and to overcome an otherwise necessary overdimensioning of the entire swivel zone.

This purpose is attained according to a further inventive thought by the stepping plate having a bearing surface thereon which faces the holding or lever arm, in which bearing surface is supported the bearing part of the holding or lever arm with its joint, which bearing part can be pivoted about the axle.

Through this measure, the stresses of the swivel range are for the most part absorbed by the bearing surface so that the dimensions of the axle, of the receiving points and the associated areas of the stepping plate and bearing part can be reduced without creating the risk of undesired breakage.

In a further development of the thought of the invention, the receiving points can be constructed in the lateral support parts of the stepping plate and in the form of recesses into which are received the holding pins of the bearing part, which holding pins form the axle or the holding pins are arranged on the support parts and the recesses are constructed in the bearing part.

This design facilitates the elimination of the construction of a separate receiving point in the bearing part and the holding pins can be constructed of the same material as the bearing part. Also the receiving points in the bearing parts of the stepping plate can be constructed as a recess having a small depth which increases the solidity of both the stepping plate and also of the holding or lever arm.

A further thought of the invention consists in constructing the bearing so that it is ⅓ to ½ of a circle in cross section.

This measure assures a secure fastening without requiring for the construction of the bearing the use of superfluous material, furthermore the outwardly extending end zones of the bearing have no dangerous breakage points.

BRIEF DESCRIPTION OF THE DRAWINGS

Further advantages and details of the invention will now be discussed more in detail with reference to the drawings which illustrate several exemplary embodiments.

In the drawings

FIGS. 1 and 2 are associated views of an inventive ski brake in the braking position and without the presence of a ski boot, wherein FIG. 1 is a side view and FIG. 2 is a top view;

DETAILED DESCRIPTION

Figure 1:
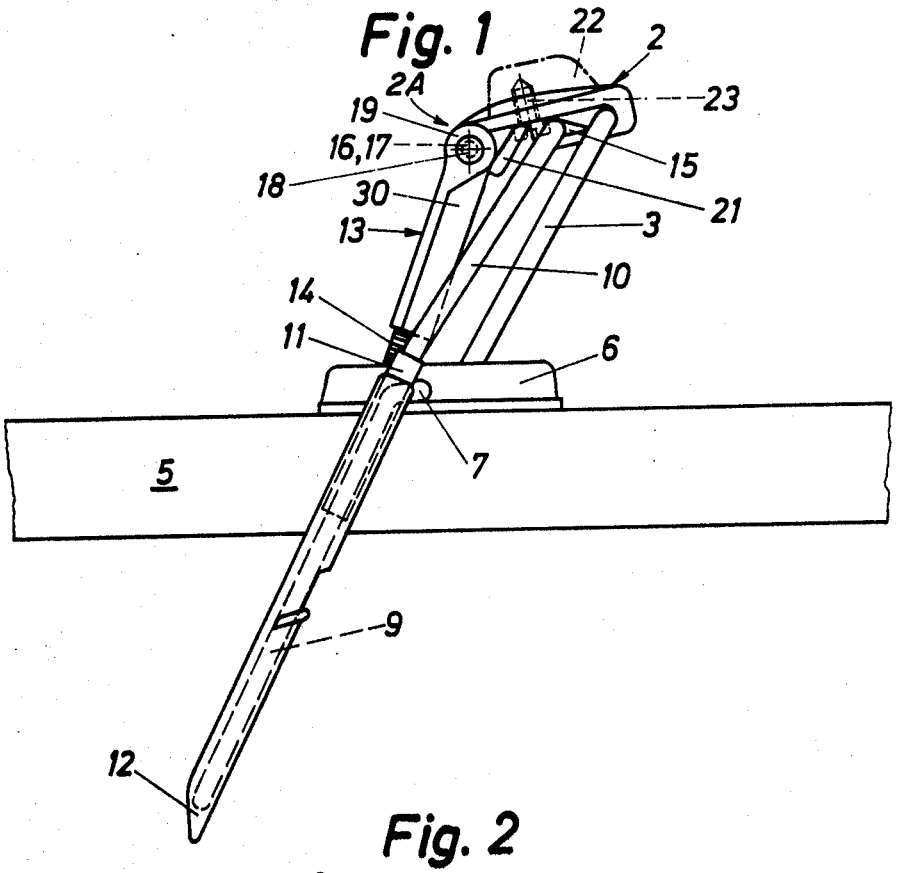
Figure 2:
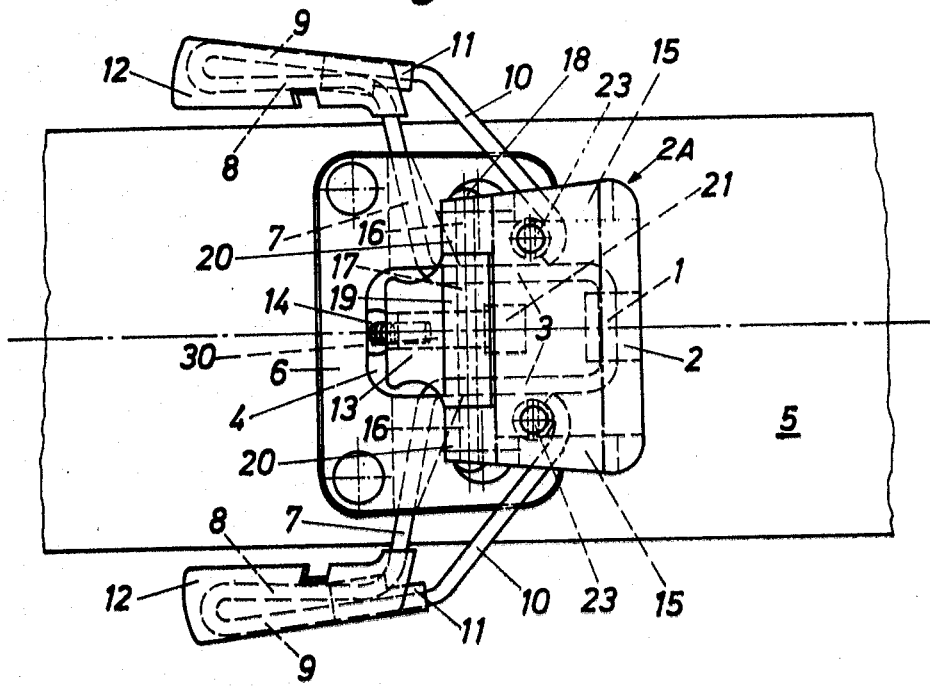

The structure of the inventive ski brake corresponds, as one can take from FIGS. 1 and 2, to the one described in U.S. Pat. No. 4,014,563, with the exception of the construction of the pedal and the holder. The cross part 1 of an approximately U-shaped spring steel wire is hingedly fastened to a stepping plate 2 which forms one part of a two part step-on assembly 2A. The spring steel wire extends with its legs 3 through a center recess 4 of a holding plate 6 which is secured on the ski 5. The spring steel wire then extends by outwardly directed bent extensions 7 under the holding plate 6 and is held thereby on the ski 5. Further, the bent sections 8 are associated with reversely bent parts 9 to form the brake legs. That is, the sections 8 and 9 which are connected are bent backwardly 180° relative to each other. The bent back sections 9 extend to provide extensions 10 which extend toward the stepping plate 2 and are there hinged or guided in slots 15.

The portions 8 and 9 of the spring steel wire, which portions are provided side-by-side and which form the braking wings are additionally reinforced by a clamp 11 on each side of the ski. Furthermore, the brake legs are encased by a plastic covering 12. A holding or lever arm 13 forms the second part of the step-on assembly 2A and is hingedly connected to the stepping plate 2 by means of an axle 18. The lever arm 13 is adjustably supported through an adjusting part 14 in the center recess 4 of the holding plate 6.

Receiving points for the axle 18, which receiving points are constructed in form of openings 16 or 17, are provided on associated parts of the stepping plate 2 and holding or lever arm 13. Therefore during assembly of the stepping plate 2 and holding or lever arm 13, a bearing part 19 on the holding or lever arm 13 is positioned laterally between the support parts 20 on the stepping plate 2 and the openings 16 and 17 are in axial alignment with one another and thus receive the axle 18 therein. Furthermore, the existence of a shoulder 21 on the stepping plate determines a defined position between the stepping plate 2 and the holding or lever arm 13 and serves to prevent an unintentional disengagement of the adjusting part 14 from the center recess 4 of the holding plate 6. The shoulder 21 can, as shown, be made in one piece out of the same material as the stepping plate 2, however, it may also be manufactured as a separate part and may for example be riveted to the lower side of the stepping plate 2.

As can further be recognized from FIG. 1, an attachment 22 may be secured on the stepping plate 2. This possibility is indicated by a dash-dotted illustration of the attachment 22 in FIG. 1. Screws 23 are used to secure the attachment 22 on the stepping plate 2.

The present ski brake operates moreover according to the disclosure in the aforesaid U.S. Pat. No. 4,014,563. Accordingly, during a positioning of the ski boot onto the ski, the stepping plate 2 is pressed downwardly and causes the device to pivot about an axis defined by the bent extensions 7 of the spring steel wire. If these extensions 7 extend at a right angle to the longitudinal axis of the ski 5, the device could pivot practically freely without resistance, It can, however, also be seen that the bent extensions 7 define an angle with respect to the longitudinal axis of the ski, which angle is different from 90°. As a result, during a stepping onto the stepping plate 2, a springy resistance to movement occurs and the device is held by the ski boot under resilient tension. If the ski boot is released, then the extensions 7, which are under tension, effect a pivoting of the brake legs 8, 9 into the braking position according to FIGS. 1 and 2 to automatically prevent the ski 5 from a sliding on.

The stepping plate 2 and the holding or lever arm 13 which are hinged together move during stepping into the ski binding together until the stepping plate 2 engages the upper surface of the ski 5. The stepping plate 2 and the holding or lever arm 13 still assume an angled position with respect to each other. During further movement of the ski boot against or toward the ski 5, a lengthening of the combination of the stepping plate 2 and the holding or lever arm 13 will occur. Since a support of the adjusting part 14 on the holding or lever arm 13 in the recess 4 of the holding plate 6 exists, the stepping plate 2 moves into the final position coplanar with the lever arm 13. As a result, the cross part 1 including the legs 3 of the U-shaped spring steel wire is pulled backwardly. The bent extensions 7, which are held under the holding plate 6, cannot directly follow this rearward movement and, as a result, the extensions 7 move both toward the center of the ski and also swing a small amount rearwardly at their inner segments. This causes the braking legs 8, 9, 10 to also swing inwardly over the top of the ski and to lie between the ski and the ski boot. Thus during downhill skiing, parts which project over the edges of the ski or laterally from the ski boot advantageously do not exist. In the case of a safety release, the brake legs 8, 9 swing first outwardly and then downwardly into the braking position, as is shown in FIGS. 1 and 2.

Also in this construction, there is the assurance that one or both of the braking legs will not get hooked on any part of the ground, for example on a tree or plant root. The power or kinetic energy (momentum) with which the ski wants to move on after the ski boot has become disengaged therefrom, is balanced out by a tilting of the entire device forwardly. If this force is overcome, then the device springs back automatically into the normal braking position. This position has not been separately illustrated in the present exemplary embodiment, because it is known, on the one hand, from the aforesaid U.S. Pat. No. 4,014,563 and, on the other hand, should be understandable for the man skilled in the art even without a special illustration.

Figure 3:
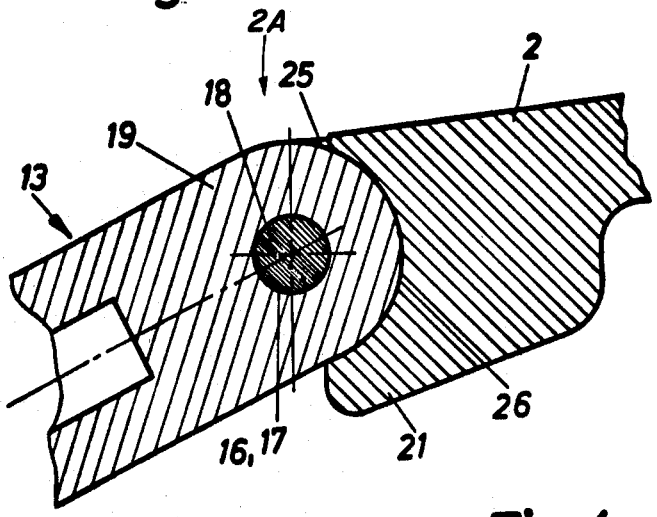
FIG. 3 is a partial cross-sectional view of the brake mechanism embodying details of the invention.
Figure 4:
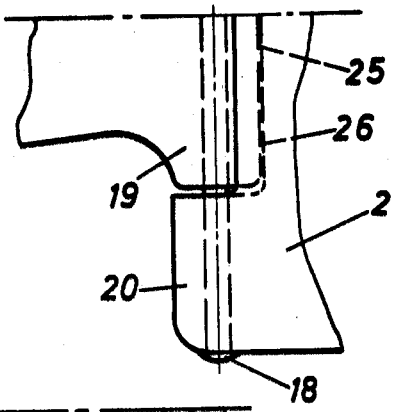
FIG. 4 is a top view of one half of FIG. 3.

From FIGS. 3 and 4, the stepping plate 2 and the holding or lever arm 13 connected to said stepping plate by means of the axle 18 are illustrated as are the openings 16, 17, the bearing part 19 of the holding or lever arm 13 and the support parts 20 of the stepping plate.

The stepping plate 2 has adjacent the area which faces the holding or lever arm 13 a bearing surface 26 in which the bearing part 19 of the holding or lever arm 13 is received and supported with its joint 25. The bearing part 19 is pivotal about the axle 18. Since the radii of the axle 18 and of the joint 25 have a common centerpoint, the axle 18 can be used exclusively for holding the stepping plate 2 and the holding or lever arm 13 together, whereas, the stresses are absorbed through the joint 25 by the bearing surface 26. In this manner, it is possible to make the dimensions of the connecting parts smaller, namely the diameter of the axle 18, the diameter of the openings 16 and 17 and the outer dimensions of the bearing part 19 and the associated area of the stepping plate 2.

Figure 5:
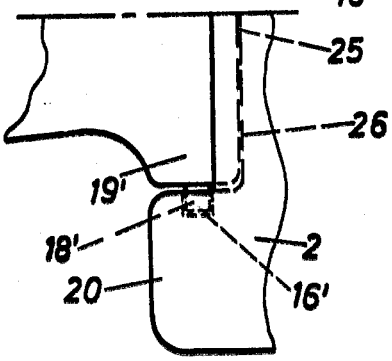
FIG. 5 is a top view of a different embodiment of a jointed axle construction.

In the embodiment according to FIG. 5, a further simplification is shown. Here the bearing parts 20 of the stepping plate 2 have receiving points which are constructed in the form of recesses 16' into which holding pins 18' of the bearing part 19', which holding pins form the axle, are received. Furthermore, one can recognize from FIG. 5 that the bearing part 19' has no bore therethrough, because the axle of the two holding pins 18', which can be constructed of the material of the holding or lever arm 13 and are preferably constructed of such material, assure a bore-free design. The construction of bearing 26 and joint 25 corresponds, by the way, to the embodiment according to FIGS. 3 and 4.

As will be recognized from FIG. 3, the bearing surface 26 is constructed to be approximately one-third of a circle in cross section. It is easily conceivable to enlarge the cross section of the bearing surface 26; one will advantageously not exceed a semicircular design, however.

The invention is not limited to the illustrated exemplary embodiments. Further variations are possible without departing from the scope of protection. For example, it will be possible to construct the support parts on the holding arm and to have them laterally embraced by a center mounting having an opening therethrough on the stepping plate. In this case, one would then have to arrange two shoulders or the like on the two lateral areas of the lower side of the stepping plate, wherein then the support web would conveniently also be constructed extending toward both sides.

It would also be possible to manufacture the holding pins as separate structural elements and to fixedly insert same in lateral recesses on the bearing part of the holding or lever arm. It is also conceivable to mount the holding pins on the two support parts of the stepping plate and to permit recesses of the bearing part to cooperate with same.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a run-away preventing device for a ski having a bar with brake legs supported on said ski, said bar being movable automatically under spring action into a braking position wherein said brake legs project downwardly from said ski on opposite sides thereof, a holding plate secured to said ski and step-on means pivotally secured to said holding plate, said bar having two extensions extending from each of said brake legs, one of which is pivotally supported on said holding plate and thereafter extends to said step-on means and the other extension extends directly to said step-on means, the improvement comprising wherein said step-on means includes a lever arm and first pivot means pivotally securing said lever arm to said holding plate, a stepping plate and second pivot means pivotally securing said stepping plate to said lever arm, said second pivot means including an axle fixed to one of said lever arm and said stepping plate and receiving means on the other of said lever arm and said stepping plate for receiving said axle therein and shoulder means on one of said stepping plate and said lever arm and engageable with the other thereof to limit the relative pivotal movement therebetween.

2. The improved ski brake according to claim 1, wherein said stepping plate has a pair of laterally spaced support parts, wherein said lever arm has a bearing part which is straddled laterally by said support parts, wherein said receiving means is provided on both of said stepping plate and said lever arm and is constructed in form of openings, said openings being held in alignment by said axle.

3. The improved ski brake according to claim 1, wherein said shoulder means is mounted on said stepping plate and is constructed in one piece of the same material as the stepping plate.

4. The improved ski brake according to claim 1, including an attachment mounted on said stepping plate, the vertical cross section of which attachment lies in longitudinal direction of said ski and corresponds substantially to the cross section of a recess of an associated ski boot, wherein the corresponding areas of support and recess have preferably a common tangent which determines the position of said stepping plate in clamped-in condition of said ski boot.

5. The improved ski brake according to claim 4, wherein said attachment includes means for releasably securing said attachment to said stepping plate.

6. The improved ski brake according to claim 1, wherein said stepping plate has a first bearing surface on its area which faces said lever arm, wherein said lever arm has a second bearing surface slidingly engaging said first bearing surface in response to a relative movement therebetween.

7. The improved ski brake according to claim 6, wherein said first bearing surface is constructed to be $\frac{1}{3}$ to $\frac{1}{2}$ of a circle in cross section.

8. The improved ski brake according to claim 1, wherein said receiving means is provided on said stepping plate and said axle is provided on said lever arm.

9. The improved ski brake according to claim 8, wherein said stepping plate has a pair of laterally spaced support parts, wherein said receiving means is provided on said support parts and is constructed in form of recesses, said lever arm having a pair of axially aligned holding pin extensions thereon received in said recesses to form said axle.

10. The improved ski brake according to claim 1, wherein said receiving means is provided on both of said stepping plate and said lever arm and is constructed in the form of openings, said openings being held in axial alignment by said axle.

* * * * *